United States Patent [19]

Florkey

[11] 4,320,902

[45] Mar. 23, 1982

[54] PITCHING TRACK GAME

[76] Inventor: Arthur G. Florkey, 3925 Heatherwood West, Traverse City, Mich. 49684

[21] Appl. No.: 237,369

[22] Filed: Feb. 23, 1981

[51] Int. Cl.[3] ..... A63F 7/20; A63F 7/02

[52] U.S. Cl. ..... 273/352; 273/85 R; 273/87 R; 273/89; 273/120 R; 273/123 R; 273/399

[58] Field of Search ..... 273/90, 108, 109, 110, 273/111, 113, 115, 116, 118 R, 119 R, 120 R, 121 R, 122 R, 124 R, 129 Q, 129 W, 352, 85 R, 87 R, 89, 123 R, 125 R, 399

[56] References Cited

U.S. PATENT DOCUMENTS

| | | | |
|---|---|---|---|
| 1,226,028 | 5/1917 | Taylor | 273/119 R |
| 1,281,093 | 10/1918 | Strade | 273/352 |
| 2,468,194 | 4/1949 | Hall | 273/108 |
| 2,631,854 | 3/1953 | Volman | 273/90 |
| 2,967,713 | 1/1961 | Kumpman | 273/119 |
| 3,358,997 | 12/1967 | Belz | 273/120 R X |
| 3,618,949 | 11/1971 | McLain et al. | 273/110 |
| 3,931,973 | 1/1976 | Moe | 273/129 Q X |

FOREIGN PATENT DOCUMENTS

| | | | |
|---|---|---|---|
| 585797 | 12/1924 | France | 273/118 R |

*Primary Examiner*—Richard T. Stouffer

[57] ABSTRACT

A game having a pitching track suspended above a game board is disclosed. The pitching track may be tilted thereby allowing a ball to roll downward toward a device for striking the ball. After being struck, the ball is propelled onto the game board where the ball's resting point designates a certain score. In a preferred embodiment, a struck ball is captured by a curvilinear ramp which returns the ball to the pitching track, thereby enabling a single player to practice striking the ball continuously, without interruption.

1 Claim, 6 Drawing Figures

PITCHING TRACK GAME

TECHNICAL FIELD

This application relates generally to game boards, or tables, for household or commercial uses, such as in a pinball arcade. More particularly, it pertains to the employment of a pitching track, suspended above a game board, on which a ball may roll toward means for striking the ball onto the game board.

BACKGROUND OF THE INVENTION

In the past, household game boards employing a conventional small ball and means for striking the ball have been known. Many of the game boards resemble a miniature baseball, basketball or hockey game. The prior games lacked versatility, could become monotonous, were large and cumbersome, held attraction for only a limited age group, did not require or develop motor skills, failed to develop eye-hand coordination, could not be played by the handicapped, required a specific number of players, could not be played alone, and were frequently difficult to maintain.

It would appear advantageous to provide a household game which requires skill in delivering and striking a moving ball, and one which can be enjoyed by any age group and by any number of players.

It is also noted that the prior art frequently failed to consider the needs of the handicapped in playing ball games. Seldom is a game which requires eye-hand coordination available for one or more persons in a wheelchair who still have the use of at least one upper extremity.

SUMMARY OF THE INVENTION

In accordance with the foregoing background discussion, an object of this invention is to provide a conveniently sized household game for one or more players of any age, which requires skill.

With the foregoing in mind, a pitching track balanced at its mid-point, extending above the game board is disclosed and claimed herein. The pitching track can be tilted manually or by the weight of the ball, and it automatically returns to a horizontal position by virtue of a biasing mechanism, such as a spring. A ball will roll down the inclined pitching track toward a means for striking the ball. The striking means causes the ball to be deflected toward the pitching track onto the game board. When the ball departs from the pitching track, the biasing mechanism causes the pitching track to return to its horizontal position in order to avoid contacting the ball after it is hit by the striking means. Since the pitching track automatically returns to a horizontal position when the ball leaves the track, one player may play alone.

The game may also be enjoyed by two or more players or teams. One player would pitch the ball and adjust the velocity of the ball by tilting the pitching track. The other player, positioned at the opposite side of the game board, employs the means for striking the ball in hitting the ball onto the game board. The game board has sides to prevent the ball from rolling off. The ball bounces randomly on the game board and eventually comes to rest. The location of the ball's eventual resting point is used in scoring the game. For example, the ball may fall through a slot or land upon a colored area of the game board for scoring.

In a preferred embodiment, which enables one player to improve skill in striking the ball, a curvilinear ramp is placed upon the game board. The concave side thereof faces the player with the striking means. The curvilinear ramp causes a struck ball to curve upward from the track and it then deposits the ball upon the middle of the pitching track. The weight of the ball causes the pitching track to tilt toward the player and the ball rolls in that direction. The player then strikes the ball and the process repeats itself. In this fashion a single player can develop the skill to accurately strike the ball.

DETAILED DESCRIPTION

Figure 1:
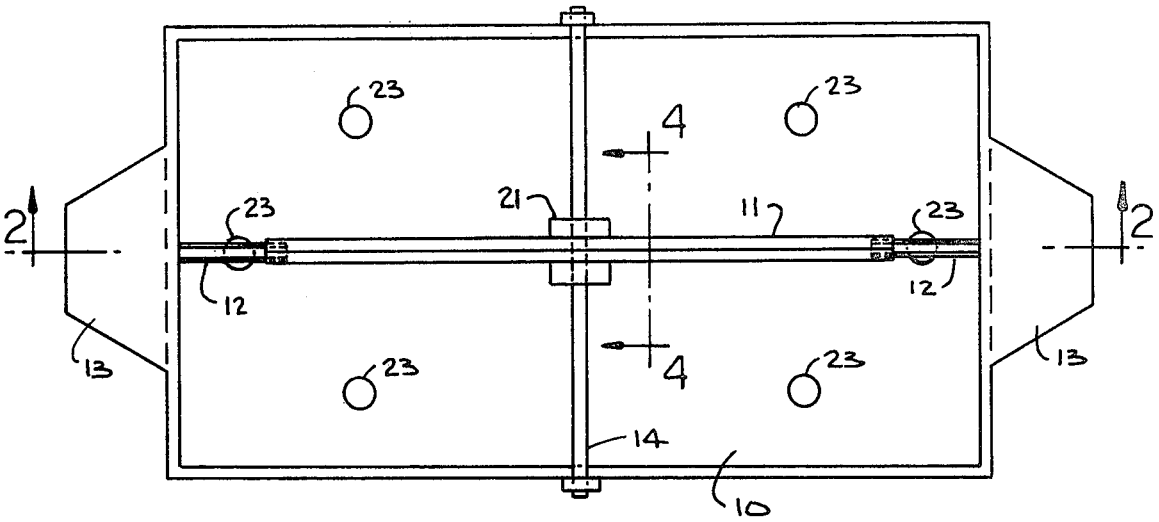
FIG. 1 is a Top View of the game board.
Figure 2:
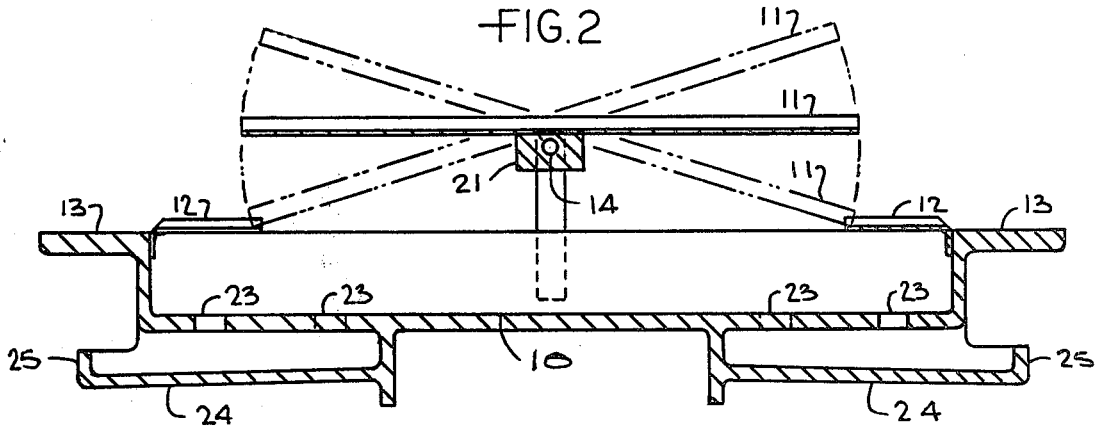
FIG. 2 is a Vertical Section of the game board on 2—2 with the pitching track shown in three (3) separate positions.

Referring now to the drawings, particularly to FIGS. 1 and 2, there is illustrated a game board 10 in accordance with one embodiment of the invention. FIG. 2 shows the pitching track 11 in its usual horizontal position in solid lines, and tilted in both directions in broken lines. When the pitching track 11 is tilted in either direction, it eventually comes to rest on a receiving track 12. Extending distally from both receiving tracks 12 is a batter's loft 13.

A ball is pitched by placing it upon a pitching track 11 which is balanced and rotatably mounted on a crossbar 14 which extends across the game board 10. The ball then rolls onto the receiving track 12 and then onto the batter's loft 13. A means for striking the ball is placed upon the batter's loft 13. Such means could comprise a pendulum club as depicted in FIG. 3.

Figure 3:
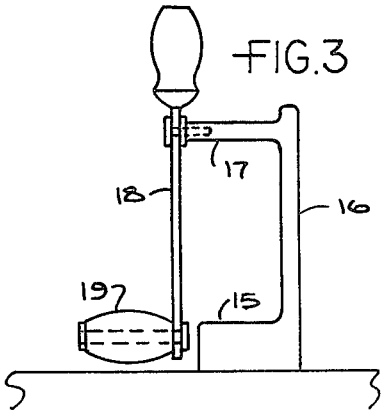
FIG. 3 is a Front View of the striking means.

The pendulum club as shown in FIG. 3 comprises a base 15, a vertical arm 16 extending upward from said base 15, a horizontal arm 17 affixed to the top of the vertical arm 16 and which extends over the base 15. The pendulum arm 18 is rotatably mounted to the horizontal arm 17. Projecting from the radial end of said pendulum arm 18 is a horizontal striker 19. A player would swing the pendulum arm 18 in an effort to strike a pitched ball with the striker 19. It should be noted that the pendulum club in FIG. 3 is the best mode of striking the ball presently known to the inventor. Other means for striking the ball may be developed without departing from the scope of the invention claimed herein.

Two or more players or teams could enjoy the game described herein. One player would pitch the ball toward the other. The pitcher would employ skill in modifying the speed and the delivery of the pitched ball by tilting the pitching track 11 to differing angles. The opposing player would employ skill in striking the ball by orienting and swinging the pendulum arm 18.

Figure 4:
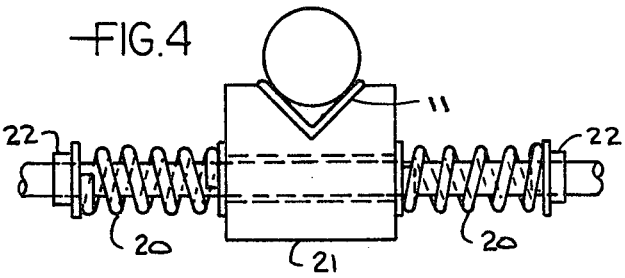
FIG. 4 is a Vertical Section along line 3—3 of FIG. 2, also showing the outline of a ball.

The game is also designed for use by one player. The player could place the ball onto the pitching track 11 and the weight of the ball would cause the pitching track 11 to tilt, thereby rolling the ball toward the receiving track 12. After the ball leaves the pitching track 11 and rolls onto the receiving track 12, it will be necessary for the pitching track 11 to avoid interfering with the ball after it is struck by the means for striking the ball, such as shown in FIG. 3. This is accomplished by providing a biasing mechanism which influences the pitching track to naturally assume a horizontal posture. The best mode of such biasing mechanism presently known to the inventor is set forth in FIG. 4. A spring 20 encircling the cross-bar 14 is pressed against a pitching track cradle 21 upon which the pitching track 11 is mounted. Spring pressure is maintained by a nut or clamp 22 affixed to the cross-bar 14. A spring 20 and nut 22 combination is provided on both sides of the pitching track cradle 21. Spring tension will cause the pitching track 11 to naturally assume a horizontal posture.

The game may be scored in an infinite number of different methods. The game board 10 may be provided with differing multi-colored designs, for example, a baseball diamond or golf course could be depicted. The colored area on which the ball comes to rest may correspond to a certain score used in scoring the game. In addition to scoring the game according to color, holes 23 may be provided on the game board 10. A designated score may correspond to the ball falling through a hole 23. An inclined ball return plane 24, beneath the game board 10, causes a ball to roll toward a ball return rack 25, where the player may conveniently retrieve the ball.

Figure 5:
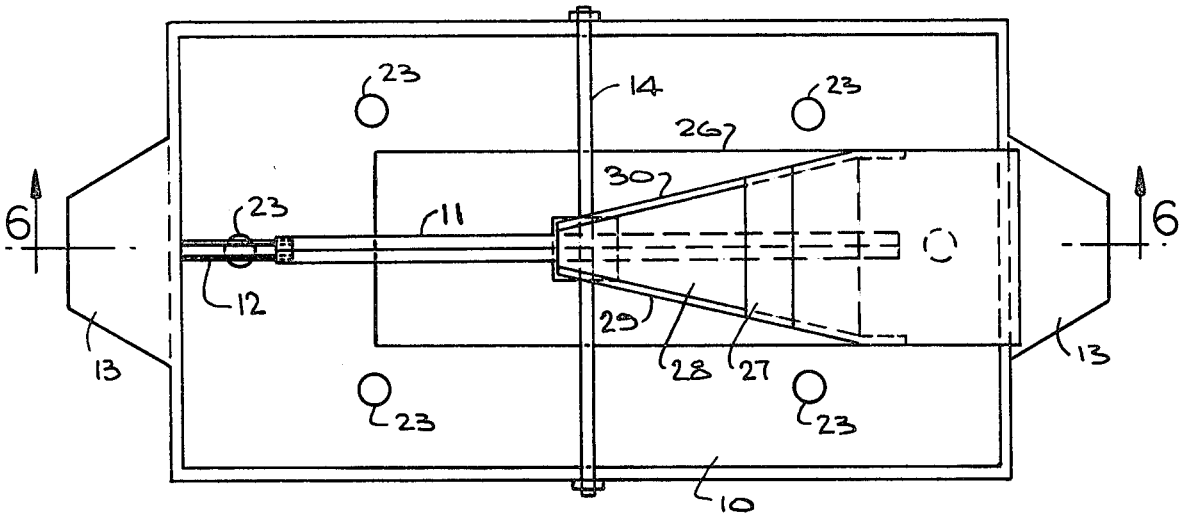
FIG. 5 is a Top View of the game board with the curvilinear track installed.
Figure 6:
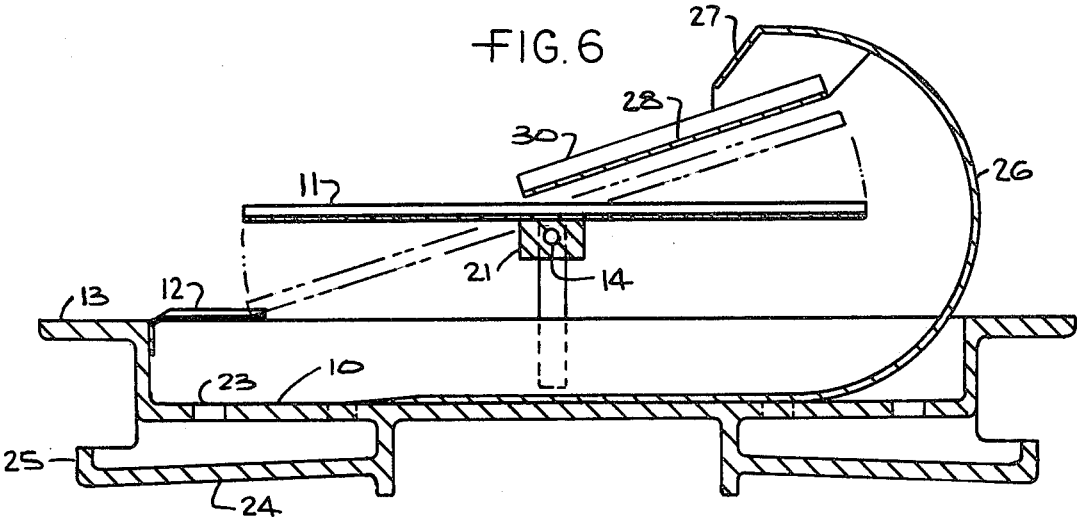
FIG. 6 is a Vertical Section along line 6—6 of FIG. 5, showing the pitching track in two (2) separate positions.

In a preferred embodiment, a sole player may continuously practice striking the ball without the necessity of repeatedly placing the ball upon the pitching track 11. A curvilinear ramp 26, this purpose, is depicted in FIGS. 5 and 6. Ramp 26 is co-terminus with the game board 10 as shown in FIG. 6. It then curves upward in an arc extending generally radially from the pitching track 11 when tilted. For the upper portion of the ramp 26, where it achieves a generally horizontal angle, a ramp lip 27 which angles generally downward is provided. Suspended beneath the ramp lip 27 is a delivery channel 28 which inclines toward the point where the pitching track 11 is balanced upon the cross-bar 14. The delivery channel 28 has two side beams 29 and 30. The side beams 29 and 30 would tend to route a ball near the point where the pitching track 11 is balanced upon the cross-bar 14. After a sole player strikes a ball onto the game board 10, the ball is caused to follow the curved contour of the ramp 26. The ball is then forced to drop onto the delivery channel 28 by the downward extending ramp lip 27. The delivery channel 28 deposits the ball onto the pitching track 11. The weight of the ball tilts the pitching track 11 and the ball rolls onto the receiving track 12. Upon departing from the pitching track 11, the biasing mechanism (FIG. 4) causes the pitching track 11 to return to a horizontal position. The ball rolls from the receiving track 12 onto the batter's loft 13 to be struck by the pendulum club depicted in FIG. 3. By this time the pitching track 11 will have lifted from the receiving track 12, as stated above, so as not to interfere with the path of the struck ball. The ball is propelled toward the ramp 26 and the process repeats itself thereby enabling a sole player to enhance his skill in striking the ball.

With this arrangement, as described in detail, it should become apparent that there has been provided a versatile game which can be enjoyed by any number of players or teams, of any age or sex or physical characteristic. Means are also provided for a single player to sharpen his skills in striking the ball continuously, without interruption.

While one specific embodiment of the invention has been described in detail above, it is to be understood that various modifications may be made for the specific details described, without departing from the spirit and scope of the invention.

What is claimed is:

1. A game board having elevated sides to retain a ball wherein the invention comprises:

a. an elevated cross-bar extending across said game board;

b. a pitching track balanced and rotatably mounted on said cross-bar;

c. a biasing mechanism on said cross-bar causing said pitching track to assume a horizontal posture;

d. a horizontal receiving track, on opposing sides of said game board, upon which said pitching track rests when tilted;

e. a batter's loft extending distally from said receiving track;

f. means for striking a ball on said batter's loft;

g. a curvilinear ramp coterminus with said game board on its lower portion and then curling upwards in an arc extending generally radially from said pitching track when tilting;

h. a ramp lip angled downward on the upper portion of said curvilinear ramp;

i. a delivery channel suspended beneath the ramp lip which inclines downward toward the point where said pitching track is balanced upon said cross-bar; and j. two side beams forming a "V", along the sides of the said delivery channel which tend to route a ball near the point where said pitching track is balanced upon said cross-bar.

* * * * *